United States Patent [19]

Sato

[11] Patent Number: 5,059,360

[45] Date of Patent: Oct. 22, 1991

[54] LID FOR CAN-LIKE CONTAINER AND METHOD FOR MAKING AN EASILY OPENED CONTAINER LID

[75] Inventor: Wasuke Sato, Tokyo, Japan

[73] Assignee: Showa Denko K.K., Tokyo, Japan

[21] Appl. No.: 454,570

[22] Filed: Dec. 21, 1989

Related U.S. Application Data

[62] Division of Ser. No. 334,632, Apr. 7, 1989.

[30] Foreign Application Priority Data

Apr. 7, 1988 [JP] Japan ..... 63-84018

[51] Int. Cl.[5] ..... B29C 65/08; B29C 59/00

[52] U.S. Cl. ..... 264/23; 156/69; 156/73.1; 156/272.2; 220/270; 264/25; 264/254; 413/12

[58] Field of Search ..... 264/254, 255, 263, 267, 264/268, 269, 248, 23, 32 D, 25; 156/303.1, 73.1, 272.2, 293, 69, 245; 220/270, 265; 413/12, 14, 15, 16, 17

[56] References Cited

U.S. PATENT DOCUMENTS

| | | | |
|---|---|---|---|
| 2,806,628 | 9/1957 | Morrill et al. | 413/16 |
| 3,257,258 | 6/1966 | D'Andrea et al. | 156/293 |
| 3,338,199 | 8/1967 | Taylor | 413/17 |
| 3,632,461 | 5/1969 | Gayner | 220/270 |
| 3,884,382 | 5/1975 | Ball | 220/272 |
| 4,165,016 | 8/1979 | Moller | 220/270 |
| 4,210,618 | 7/1980 | Piltz et al. | 156/69 |
| 4,230,659 | 10/1980 | Sutch | 264/320 |
| 4,232,622 | 11/1980 | Weierman et al. | 156/69 |
| 4,360,121 | 11/1982 | Helms | 220/270 |
| 4,735,336 | 4/1988 | Buchner et al. | 220/270 |
| 4,784,284 | 11/1988 | Miyauchi et al. | 220/270 |
| 4,828,135 | 5/1989 | Kawakami et al. | 220/270 |
| 4,828,494 | 1/1984 | Hirota et al. | 220/270 |

FOREIGN PATENT DOCUMENTS

| | | |
|---|---|---|
| 0004834 | 10/1979 | European Pat. Off. . |
| 0094359 | 11/1983 | European Pat. Off. . |
| 0256477 | 2/1988 | European Pat. Off. . |
| 2178719 | 2/1987 | United Kingdom . |

*Primary Examiner*—Willard E. Hoag

*Attorney, Agent, or Firm*—Sughrue, Mion, Zinn, Macpeak & Seas

[57] ABSTRACT

A method for making a lid for a can-like container is disclosed which comprises a gas barrier-type multi-layer base for the lid, a reinforcing thermoplastic resin layer formed on said multi-layer base, and a tab seat of synthetic resin having a tab and formed on that portion of the upper surface of the bottom surrounded by said reinforcing thermoplastic resin layer. The tab seat is disposed in spaced relation to said upper surface of the bottom and disposed in such a manner that a score portion having as small a width as possible is formed between the outer periphery of the tab seat and the inner peripheral edge of said reinforcing thermoplastic resin layer. The upper surface of said bottom is exposed through the score portion.

12 Claims, 9 Drawing Sheets

LID FOR CAN-LIKE CONTAINER AND METHOD FOR MAKING AN EASILY OPENED CONTAINER LID

This is a divisional of application No. 07/334,623, filed Apr. 7, 1989.

BACKGROUND OF THE INVENTION

This invention relates to a lid for a can-like container and a method of manufacturing such a lid and more specifically to lids for various can-like containers such as cans for holding beverage coffee, soup, food oil, seasoning, motor oil and other canned goods, the lids being made predominantly of a synthetic resin instead of metal and being of such a construction that the lid is openable without any tool such as can opener.

Applicant of the present application has earlier proposed a method of manufacturing a lid of the above-mentioned type which is made predominantly of a synthetic resin and is openable without any tool such as a can opener (Japanese Patent Application No. 11238/87).

This manufacturing method will now be described with reference to the drawings. As shown in FIG. 5, a multi-layer base 23 having gas barrier properties is inserted in one injection mold 19 (i.e., right-hand mold in this Figure) in such a manner as to cover a surface of this mold.

For example, as shown in FIG. 10, the multi-layer base 23 of the gas barrier type comprises at least three layers, that is, an inner base layer 39 of the gas barrier type made, for example, of an aluminum foil, and opposite outer surface layers 40 and 41 of a thermoplastic resin. As shown in FIG. 5, preferably, the multi-layer base 23 is preformed into a container-like shape having a bottom, an upstanding portion (peripheral wall) extending from the outer periphery of the bottom, and a flange extending from the upstanding portion in parallel relation to the bottom. The multi-layer base 23 is inserted in the above mold in a manner mentioned above.

As shown in the drawings, a thermoplastic resin layer 26, which serves to reinforce at least the upstanding portion and flange of the container-like multi-layer base 23 (hereinafter referred to as "preformed base 23") for the lid for a can-like container, is formed on the preformed base 23 in such a manner that the thermoplastic resin layer 26 extends from the outer peripheral edge portion of the bottom of the preformed base 23 to the end of the flange and further projects therefrom in parallel relation to the upstanding portion in a direction opposite to the upstanding direction of the upstanding portion (the layer 26 is hereinafter referred to as "a flap portion 27" including the above oppositely-projecting portion 26').

Three molds 12, 13 and 14 are formed on a core-side surface of the other injection mold 9.

FIG. 4A shows the positional relation between these three molds as viewed from the core side. As shown in this Figure, the mold 12 in the form of a circular strip is formed on the core-side surface of the injection mold 9 at its outermost portion, and the mold 13 in the form of a horseshoe-shaped strip is disposed inside the mold 12 and is spaced from the upper portion of the mold 12. The mold 14 similar in shape to the mold 13 is disposed inside the mold 13 in spaced relation thereto, the mold 14 having the same height as the mold 13 and having upper ends directed inwardly toward each other.

FIG. 4B is a top plan view of a horseshoe-shaped tab (finger grip) 15 made of a synthetic resin, and FIG. 4C is an enlarged cross-sectional view taken along the line A—A of FIG. 4B, and FIG. 4D is a side-elevational view of the tab 15. As shown in FIG. 4A, the tab 15 is beforehand mounted on the core-side surface of the injection mold 9, on which the molds 12, 13 and 14 are formed, in such a manner that an upper end of a fixing portion 16 of the tab 15 is held in abutting engagement with the inner surface of the circular mold 12, with a body 17 of the tab 15 interposed between the molds 13 and 14.

The front end portion (fixing portion) 16 of the tab 15 has an oval hole 18 extending therethrough, as shown in FIG. 4A.

As shown in FIG. 5, the tab 15 is mounted on the injection mold 9 in such a manner that the through hole 18 is disposed in registry with an injection port 11.

Since the fixing portion 16 of the tab 15 is stepped with respect to the tab body 17 as shown in FIG. 4C, there is a spacing between the rear or lower surface of the fixing portion 16 and the upper surface of the preformed base 23.

As described above, the preformed base 23 with the flap portion 27 (hereinafter referred to as "lid body 20") is set on the surface of the one (i.e, right-hand) injection mold 19 disposed on its cavity side (FIG. 5), and then a mold closing or clamping is carried out as shown in FIG. 6.

After this mold closing operation, an injection molding material 22 (which is hereinafter often referred to merely as "injection resin") is injected into a cavity 21 through a resin flow path 10 and the injection port (gate) 11 in the injection mold 9, as shown in FIG. 7.

Since the through hole 18 of the tab 15 is disposed in registry with the injection port 11 as described above, the molten injection resin 22 flows through the through hole 18 and further flows to the backside of the fixing portion 16 of the tab 15.

The injection resin 22 thus fed to the backside of the fixing portion 16 flows into an area delimited by the innermost mold 14 and also flows from the fixing portion 16 of the tab 15 in right and left directions (FIG. 4A) into an area formed between the circular mold 12 and the mold 13. The manner of such flow is shown in FIG. 4A.

The injection resin 22 thus fed deposits on the surface of the preformed base 23 of the lid body 20 at the backside of the fixing portion 16 of the tab 15, and also the injection resin 22 fed to the area delimited by the mold 14 deposits on the surface of the preformed base 23 at that area. At the same time, the injection resin 22 fed to the area formed between the circular mold 12 and the mold 13 deposits on the surface of the preformed base 23 at that area.

Then, after the mold is cooled, the mold is opened to remove the molded product (the lid) therefrom, thus obtaining the lid 24. FIG. 8 is a plan view of the lid 24, and FIG. 9 is an enlarged cross-sectional view taken along the line B—B of FIG. 8.

As shown in FIG. 9, the injection resin 22 has not been deposited on the preformed base 23 at that portion where the mold 12 has been present and also at the area between the molds 13 and 14, and therefore these portions of the preformed base 23 are exposed to provide grooves 30 and 31.

The injection resin (layer) 22 thus deposited on the area surrounded by the circular mold 12 constitutes a tab seat 25 of the lid 24, and the through hole 18 of the fixing portion 16 of the tab 15 is filled with the injection resin 22. The fixing portion (front end portion) 16 of the tab 15 is integrally connected or fixed to the tab seat 25 by the injection resin 22 lying between the backside of the fixing portion 16 and the surface of the multi-layer base 23 disposed in opposed relation thereto.

As shown in FIG. 9, since the tab 15 is thus fixed at its front end portion 16, the other end of the tab body 17 is spaced from the preformed base 23 (although the other end is not always raised as in the drawings).

Thus, there is obtained the lid 24 which is made predominantly of synthetic resins and comprises the preformed base 23, the flap portion 27 extending from the outer peripheral edge of the bottom of the preformed base 23 to the outer end of the flange of the preformed base 23 and further projecting in parallel relation to the upstanding portion of the preformed base 23, the tab seat 25 formed or deposited on that portion of the upper bottom surface of the preformed base 23 surrounded by the flap portion 27, and the tab 15 secured at its one end to the tab seat 25.

The lid 24 has a score portion 30 of a circular shape having a substantially uniform thickness or width over the entire circumference thereof, the score portion being the exposed portion of the preformed base 23 and being formed as a result of the presence of the circular mold 12. The tab seat 25 and the flap portion 27 (the reinforcing thermoplastic resin layer 26) are spaced apart by the score portion 30.

For example, as shown in FIG. 13, the lid 24 is connected to a can-like container 42 by heat-bonding or sealing the flap portion 27 of the lid 24 to a peripheral wall 43 of the can-like container 42 by heat bonding or sealing. The peripheral wall 43 is also made of a synthetic resin. In FIG. 13, reference numeral 44 denotes a bottom lid.

The manner of opening the lid 24 will now be described with reference to FIG. 9. When the end 33 of the body 17 of the tab 15 for opening the lid (which tab is disposed inwardly of the tab seat 25) is raised or pulled upwardly as indicated by an arrow, the fixing portion 16 of the tab 15 is depressed in the direction opposite to the direction of the arrow. When the tab 15 is further pulled upwardly, the preformed base 23 is cut at the score portion 30, so that the lid 24 is opened along the outer peripheral edge 32 of the score portion 30.

FIG. 11 is a top plan view of the lid 24 after it has been opened, and FIG. 12 is a cross-sectional view taken along the line C—C of FIG. 11.

In the above manufacturing method, although the lid body 20 with the flap portion 27 connected to the end of the preformed base 23, is beforehand inserted in the injection mold 19, only the preformed base 23 may be inserted, in which case another resin flow path 29 and another gate 28 in addition to the gate 11 are formed in the injection mold 9 as indicated in phantom in FIG. 5 so that a molten resin is injected through the flow path 29 and the gate 28 either simultaneously with or separately from the injection of the molten injection resin 22 from the gate 11, to thereby form the flap portion 27.

Also, in the above manufacturing method, although the tab 15 is beforehand abutted against the inner surface of the circular mold 12 and is interposed between the molds 13 and 14 as shown in FIG. 4A, the tab 15 may be connected to the tab seat 25 at a separate step after the tab seat 25 is formed.

The molds 13 and 14 serve to hold the tab 15 in place relative to the injection mold 9 in the case where the tab 15 is beforehand mounted in the injection mold 9, and the mold 13 also serves to prevent the outer peripheral surface of the body 17 of the tab 15 from being joined or connected to the injection resin layer 22 formed between the circular mold 12 and the mold 13.

Similarly, the mold 14 disposed inwardly of the mold 13 serves to prevent the injection resin 22, fed to the area delimited by the mold 14, from being joined to the inner peripheral surface of the body 17 of the tab 15.

Therefore, in the case where the tab 15 is not mounted on the injection mold beforehand, the molds 13 and 14 are not needed, and in such a case the tab seat 25 is formed over the entire area of the upper bottom surface of the preformed base 23 surrounded by the inner peripheral end edge of the flap portion 27.

As described above, Applicant of the present application has earlier proposed the above method of manufacturing a lid for a can-like container by injection molding. In this method, the circular mold 12 is required for forming the score portion 30, and therefore even if it is desired that the width (S) of the score portion 30 be as small as possible, that is, as close to zero ($S=0$) as possible, this is impossible because of the structure of the mold. As a result, the surface of the preformed base 23 is exposed to the exterior in an amount corresponding to the width of the score portion 30.

The present inventors have earlier studied the relationship of the width of the score portion 30, the degree of easiness to open the lid (degree of easy opening) and a rupture strength (product drop strength) of the can after it is filled with its contents, and have found the following facts (as disclosed in Japanese Patent Application No. 146943/84).

More specifically, it is generally considered that the narrower the width of the score portion 30 is, the greater resistance to withstand a breakage is obtained. However, the reverse is the case, and the greater the width of the score portion 30, the more energy is absorbed when the can is dropped, thus obtaining a greater rupture strength. In contrast, with respect to the degree of easy opening, it is considered that the wider score portion 30 provides for a higher degree of easy opening. However, the reverse is also the case, and if the score portion 30 has a great width, the preformed base 23 is susceptible to stretch or expand, which greatly affects adversely the degree of easy opening.

Therefore, the above-mentioned synthetic resin lid, which is made predominantly of synthetic resins and can be opened without the use of any tool has such contradictory characteristics, that is, the degree of easy opening and the rupture strength. If it is intended to improve one characteristic, then the other characteristic often tend to become unsatisfactory. Thus, such difficult problems have conventionally been involved in providing a container having such a synthetic resin lid, and it has been desired that the lid should have the two contradictory characteristics of a satisfactory level.

The score portion 30 is the exposed portion of the preformed base 23 which comprises a laminate composed of an aluminum foil 39 and thin layers 40 and 41 of a synthetic resin formed respectively the opposite sides of the aluminum foil 39, as later described. Therefore, there is a risk that a hole may be formed through the score portion 30, and a foreign matter is introduced or injected into the container.

In order to reduce the width of the score portion 30 to zero, it is considered that the flap portion 27 and the tab portion 25 are formed of such different synthetic resins that these two synthetic reins will not adhere to each other, thereby enabling them to be released from each other at the boundary therebetween. However, the synthetic resin layers 40 and 41, which are made of the synthetic resin which can be heat-bonded to the tab seat 25, are used to define the outer surfaces of the preformed base 23. Therefore, it is actually difficult to select suitable synthetic resins which can be released from each other at the boundary to enable the opening of the can.

Further, in the above manufacturing method, the tab seat 25 made from the molten injection resin 22 is integrally or firmly joined to the surface of the preformed base 23, and the preformed base 23 is not sufficiently stretchable at the portion thereof underlying the tab seat 25. Therefore, with respect to the internal pressure within the can, the preformed base 23 may fail to provide a sufficient buffer effect for absorbing energy produced when the can is dropped. The result is that the impact concentrates on the score portion 30 when the can is dropped.

Further, in he above manufacturing method, as shown in FIGS. 5 and 8, in order to fully open the lid, the injection gate 11 for forming the tab seat 25 and the injection gate 29 for forming the flap portion 27 must be isolated from each other. In addition, in the case where the injection gate 29 for forming the flap portion 27 is provided, the strength of the injection mold 9 is reduced to shorten a service life of the mold 9. Moreover, in such a structure, it is difficult for the gas to escape, and during the molding operation, the score portion 30 are liable to be broken or cut.

OBJECTS AND SUMMARY OF THE INVENTION

It is therefore an object of this invention to provide a technique by which the width of the score portion is made as close to zero as possible. By thus making the width of the score portion as close to zero as possible, the invention seeks to eliminate the risk of introducing or injecting a foreign matter into the can from the exterior and also to improve the degree of easy opening.

Another object of the present invention is to prevent the score portion from being exposed to an external view (at least when viewed from the top of the lid) even if the width of the score portion is increased, thereby eliminating the risk of introducing a foreign matter from the exterior. The invention also seeks to enhance a rupture strength of the can by increasing the width of the score portion on which the impact tends to concentrate when the can is dropped.

A further object of the invention is to provide a technique by which the tab seat is not integrally or firmly joined to the preformed base over the entire surface thereof, thereby enhancing the buffer effect.

A still further object of the invention is to provide a technique by which a decrease in mold strength (and hence a shortened service life) which is the drawback of the above-mentioned earlier invention is prevented, and other problems, such as the cutting or breakage of the score portion due to difficulty in gas escape, are overcome.

The above and other objects of the present invention and novel features thereof will become manifest upon making reference to the detailed description and the accompanying drawings.

The above objects have been achieved by a lid for a can-like container comprising: a gas barrier-type multi-layer base for the lid comprising at least three layers, said multi-layer base comprising an inner base layer of the gas barrier type and opposite outer surface layers of a thermoplastic resin, said multi-layer base having a bottom, an upstanding portion extending from the outer periphery of said bottom, and a flange extending outwardly from said upstanding portion; a reinforcing thermoplastic resin layer formed on said multi-layer base in such a manner that said reinforcing thermoplastic resin layer extends from the outer peripheral edge portion of said bottom to the outer end of said flange and further projects therefrom downwardly in substantially parallel relation to said upstanding portion so as to reinforce said upstanding portion and said flange; and a tab seat of a synthetic resin having a tab and formed on that portion of the upper surface of said bottom surrounded by said reinforcing thermoplastic resin layer, said tab seat being disposed in spaced relation to said upper surface of said bottom and disposed in such a manner that a score portion having as small a width as possible is formed between the outer periphery of said tab seat and the inner peripheral edge of said reinforcing thermoplastic resin layer, and said upper surface of said bottom being exposed through said score portion.

Particularly, in the above lid, the tab seat has an eave portion formed around and directed outwardly from an upper portion of the outer periphery thereof so as to cover the score portion.

In the above lid, the eave portion extends outwardly to such an extent as to cover the inner peripheral edge of the reinforcing thermoplastic resin layer disposed in surrounding relation to the score portion so that the eave portion covers the score portion.

In the above lid, the outer peripheral edge of the eave portion is fitted in a groove formed in that portion of the reinforcing thermoplastic resin layer formed on the upstanding portion of the gas barrier-type base so that the eave portion covers the score portion.

In the above lid, the tab seat has a rib formed at its lower surface so as to prevent deformation of the lid.

According to another aspect of the present invention, there is provided a method of manufacturing a lid for a can-like container comprising the steps of:

(a) preforming a gas barrier-type multi-layer base of a flat shape for the lid into a three-dimensional shape having a bottom, an upstanding portion extending from the outer periphery of said bottom, and a flange extending outwardly from said upstanding portion, said multi-layer base comprising at least three layers and comprising an inner base layer of the gas barrier type and opposite outer surface layers of a thermoplastic resin;

(b) forming a reinforcing thermoplastic resin layer on said multi-layer base in such a manner that said reinforcing thermoplastic resin layer extends from the outer peripheral edge portion of said bottom to the outer end of said flange and further projects therefrom downwardly in substantially parallel relation to said upstanding portion so as to reinforce said upstanding portion and said flange;

(c) mounting a tab seat of a synthetic resin on that portion of the upper surface of said bottom surrounded by said reinforcing thermoplastic resin layer, said tab seat being disposed in spaced relation to said upper surface of said bottom and disposed in such a manner that a score portion having as small a width as possible is formed between the outer periphery of said tab seat and the inner peripheral edge of said reinforcing thermoplastic resin layer, said upper surface of said bottom being exposed through said score portion, and said tab seat optionally having a rib formed at its lower surface; and (d) securing one end of a tab of a synthetic resin to said tab seat either before or after said tab seat-mounting step.

DETAILED DESCRIPTION OF THE PREFERRED EMBODIMENTS

Preferred embodiments of the invention will now be described with reference to the drawings.

Figure 1A:
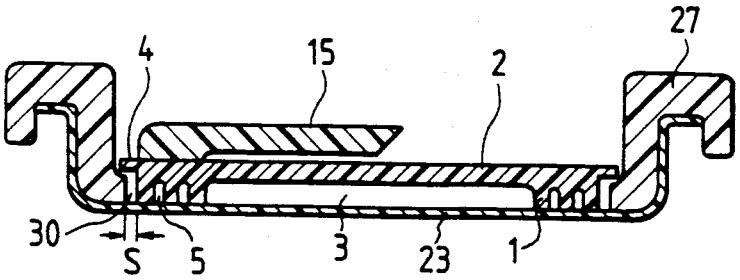
FIG. 1A is a cross-sectional view of a lid for a can-like container provided in accordance with the present invention.

FIG. 1A is a cross-sectional view of a preferred embodiment of a lid for a can-like container of the present invention.

As shown in this Figure, a tab seat 2 having ribs 1 at its lower surface is formed on that portion of an upper bottom surface of a preformed base 23 surrounded by a flap portion 27 in such a manner that a space 3 exists between the lower surface of the tab seat 2 and the upper bottom surface of the preformed base 23.

The tab seat 2 has a disc-shape.

Figure 2B:
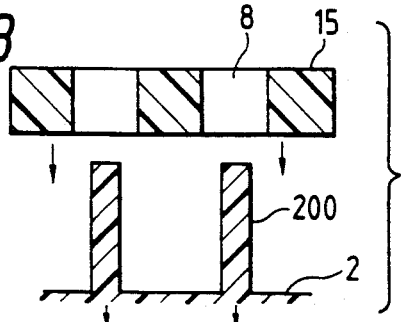
FIGS. 2B(*a*) to 2B(*c*) are cross-sectional views showing a tab-mounting operation.
Figure 2B:
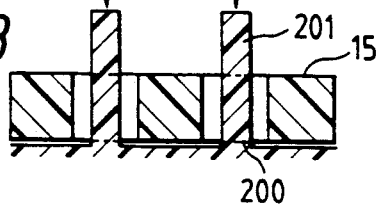
Figure 2B:
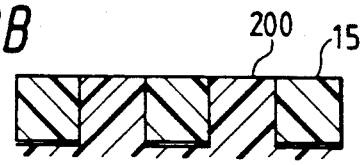
Figure 2A:
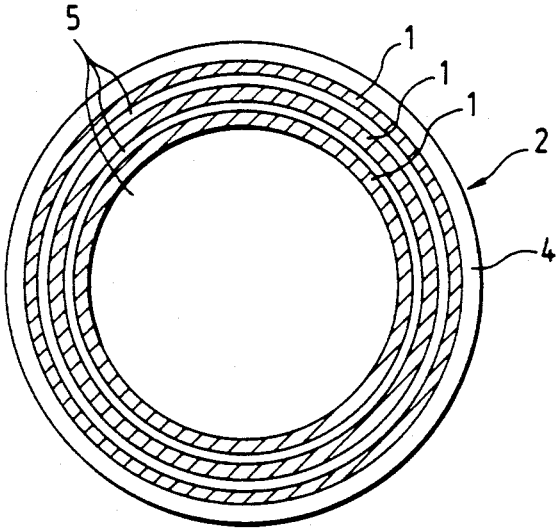
FIG. 2A is a bottom view of one example of a tab seat used in the present invention.

FIG. 2A is a bottom view of the tab seat 2.

As shown in FIGS. 1A and 2A, the tab seat 2 has an eave portion or flange 4 formed around its peripheral edge and extending outwardly therefrom.

In this embodiment, three ribs 1 are provided, and the ribs 1 are arranged in concentric relation to the eave portion 4 (the ribs 1 are shown as hatched in FIG. 2A merely for illustration purposes).

The tab seat has grooves 5 for providing the above-mentioned space 3.

As shown in FIG. 1A, a score portion 30 is formed between the inner peripheral edge of the flap portion 27 and the outermost rib 1 of the tab seat 2, and the score portion 30 is covered by the eave portion 4 and therefore is not exposed to the exterior, thereby eliminating the risk that the score portion 30 may be bored for the purpose of introducing or injecting a foreign matter from the exterior.

A tab 15 is secured to the upper surface of the tab seat 2 at its outer peripheral portion, the tab 15 being disposed inwardly of the eave portion 4.

Next, a method of manufacturing the lid according to the present invention will now be described with reference to FIGS. 3(*a*) to (*d*).

As shown in FIG. 3(a), first, there is prepared the preformed base 23 of a three-dimensional shape as described above.

It is general to adopt a stamping reduction machining for production of the preformed base 23. As desired, for production of the preformed base having a deep bottom (i.e., a high flange type), the preformed base is to be preformed according to the following procedure which the present inventors have earlier found (see Japanese Laid-Open (Kokai) Patent Application No. 90130/85).

Figure 3:
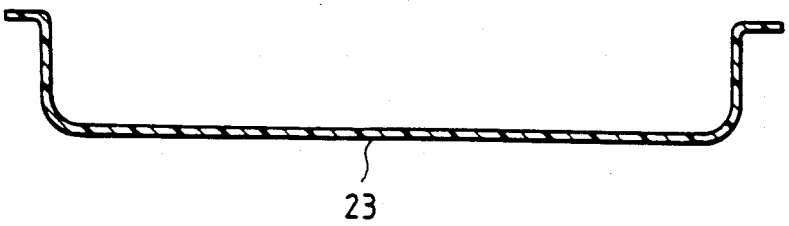
FIGS. 3(*a*) to 3(*d*) are cross-sectional views showing steps of a method of the present invention.
Figure 3:
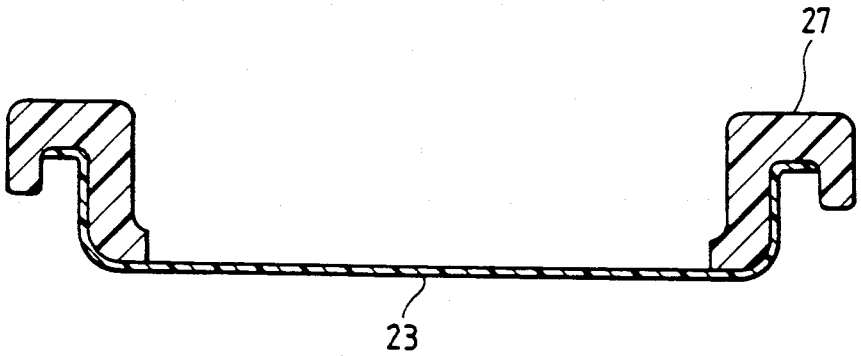
Figure 3:
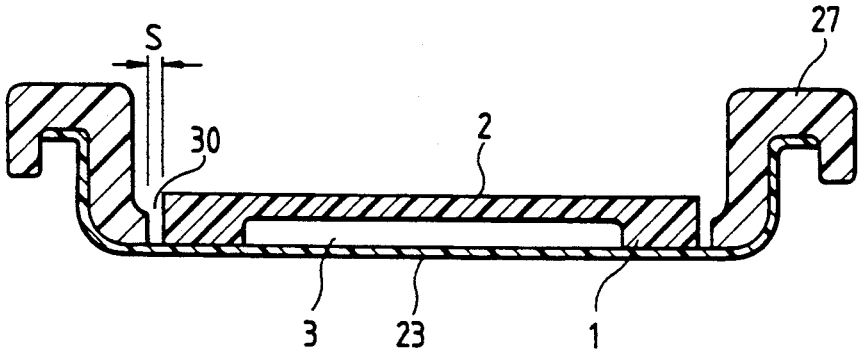
Figure 3:
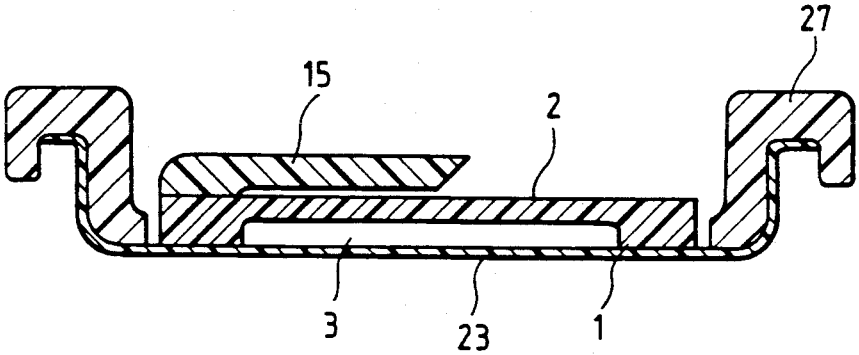

In the present invention, next, the flap portion 27 of a thermoplastic resin is formed on the peripheral portion of the preformed base 23, as shown in FIG. 3(*b*). (It is possible to simultaneously mount the flap portion 27 and the tab 2 onto the preformed base 23.)

The flap portion 27 can be formed by the above-mentioned injection molding, and alternatively the flap portion may be connected or joined at a separate step to the preformed base by ultrasonic welding, high-frequency welding or an adhesive.

Then, the tab seat 2 which has the ribs 1 and is made of a synthetic resin at a separate step is connected or joined to that portion of the upper bottom surface of the preformed base surrounded by the flap portion 27.

The most important feature of the present invention resides in the mounting of the separate tab seat 2. The size of the tab seat 2, the position of mounting of the tab seat 2 and so on are suitably adjusted so that the width S of the score portion 30 can be made as close to zero as possible.

By providing the eave portion 4 on the tab seat 2, the score portion 30 is prevented from being exposed as described above (FIGS. 1A, 1C, 1D and 1E) although in FIG. 3, the eave portion 4 is not provided.

In this case, if the inner peripheral edge of the flap portion 27 is slightly directed radially inwardly toward the center of the multi-layer base 23 (see FIGS. 1A, 1C, 1D and 1E), the effect of the eave portion 4 is increased.

Therefore, with this arrangement, the risk of devilment, such as the introduction of a foreign matter after creating a hole through the score portion 30, can be eliminated, and besides the degree of easy opening as well as the rupture strength of the can can be enhanced.

Further, if the ribs 1 are formed on the tab seat 2 to form the grooves 5 as shown in FIGS. 1A and 2A, the space 3 is formed between the lower surface of the tab seat 2 and the upper bottom surface of the preformed base 23 when the tab seat 2 is mounted on the preformed base 23. By virtue of the provision of the enclosed space 3, the area of the bottom surface of the preformed base 23 which is not joined to the tab seat 2 is increased.

This construction enhances the buffer effect of absorbing the energy relative to the internal pressure of the can when the can is dropped, and therefore the impact produced when the can is dropped is less liable to concentrate on the score portion 30.

Since the top of the space 3 is covered by the tab seat 2, there is no risk that a foreign matter is introduced into the can after a hole is formed through that portion of the preformed base 23 disposed beneath the space 3.

Further, the manufacture and mounting of the tab seat 2 are carried out at separate steps, and therefore a multiple-gate construction is not required for forming the tab seat 2 and the flap portion 27 whereas in the conventional method, such a multiple-gate construction (i.e., the injection gates 11 and 29 for the tab seat and the flap portion is needed. This simplifies the construction of the mold 9 and reduces its cost, and the service life of the mold 9 can be prolonged, and the cutting of the score portion 30 due to the difficulty of gas escape is prevented.

Preferably, the tab seat 2 is connected or joined to the preformed base 23 by ultrasonic welding or high-frequency welding. This also can be done using an adhesive.

Then, as shown in FIG. 3(*d*), the tab 15 of a synthetic resin is secured at one end thereof to the upper surface of the tab seat 2.

Preferably, the tab 15 is mounted by the following method.

Figure 2C:
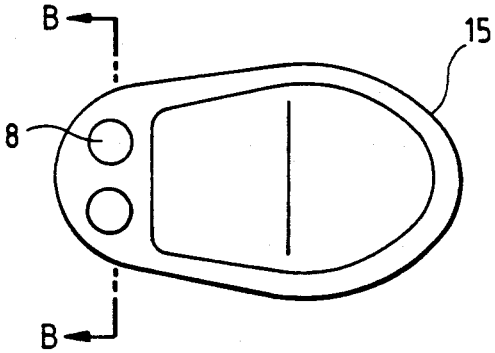
FIG. 2C is a top plan view of the tab.

One example of such method will now be described with reference to the drawings. As shown in FIG. 2C, two holes 8 are formed through the one end of the tab 15.

FIG. 2B(*a*) shows at its upper portion the cross-section taken along the line B—B of FIG. 2C.

On the other hand, as shown in a lower portion of FIG. 2B(*a*), projections 200 are formed on the upper surface of the tab seat 2, the projections 200 being long enough so as to extend through the respective through holes 8 beyond the upper surface of the tab 15.

As shown in FIG. 2B(*b*), the through holes 8 of the tab 15 are aligned with the projections 200, respectively, and then the projections 200 are caused to extend through the respective through holes 8 upwardly beyond the upper surface of the tab 15.

Ultrasonic vibration is applied to the thus projected portions 201 of the projections 200 to fuse them.

Each projection 200 of the tab seat 2 is smaller in diameter than the through hole 8 of the tab 15, and when the thus projected portion 201 is fused, the upper surface of the projection 200 lies flush with the upper surface of the tab 15. With this arrangement, as shown in FIG. 2B(*c*), the tab 15 is firmly secured to the tab seat with a high welding strength, and this is also desirable from the viewpoint of the appearance.

Figure 4A:
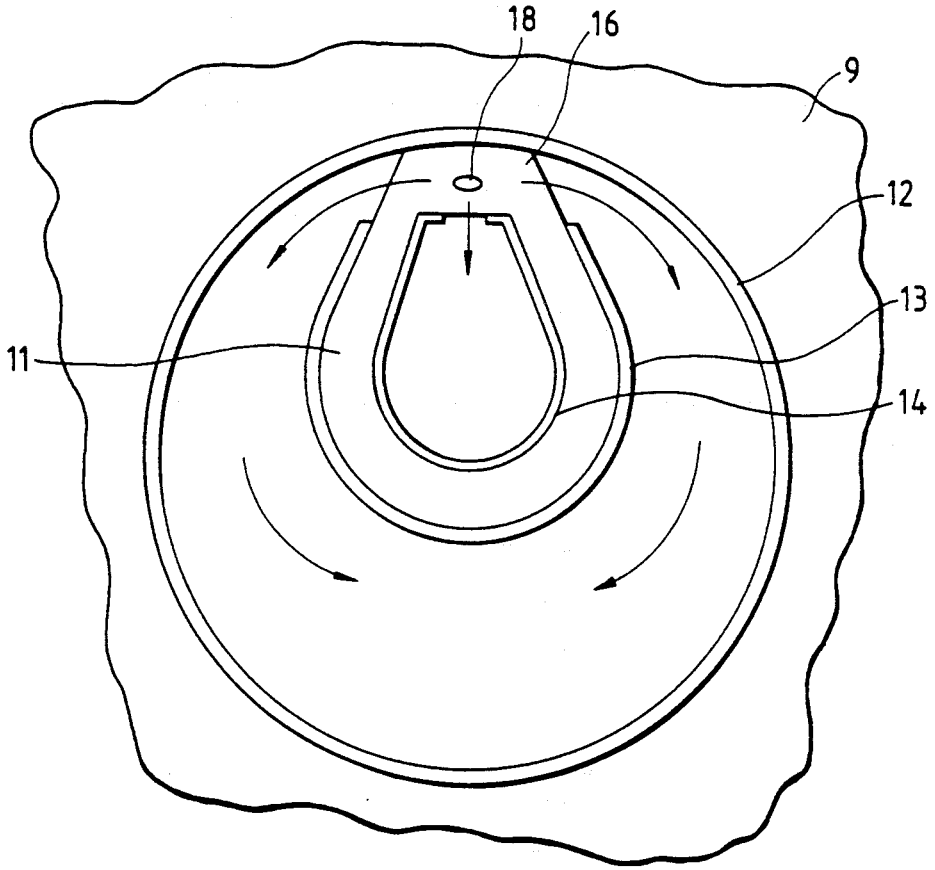
FIG. 4A is a view showing the flow of a molten injection resin with respect to a mold and a tab in the prior art.
Figure 4B:
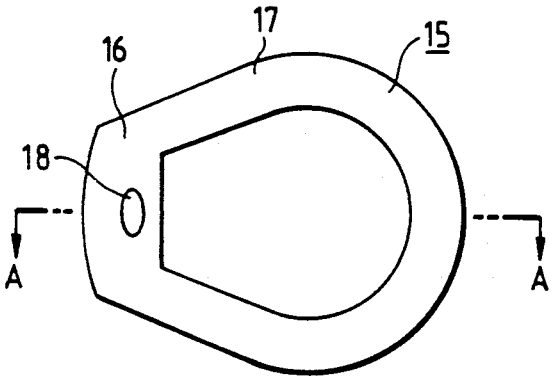
FIG. 4B is a top plan view of the tab.
Figure 4C:
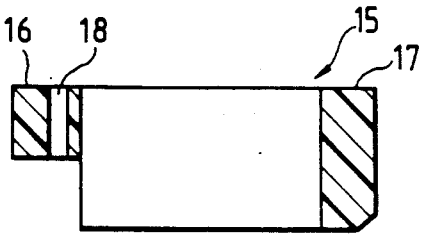
FIG. 4C is an enlarged cross-sectional view taken along the line A—A of FIG. 4B.
Figure 4D:
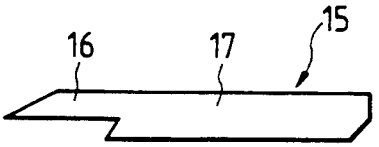
FIG. 4D is a side-elevational view of the tab.
Figure 5:
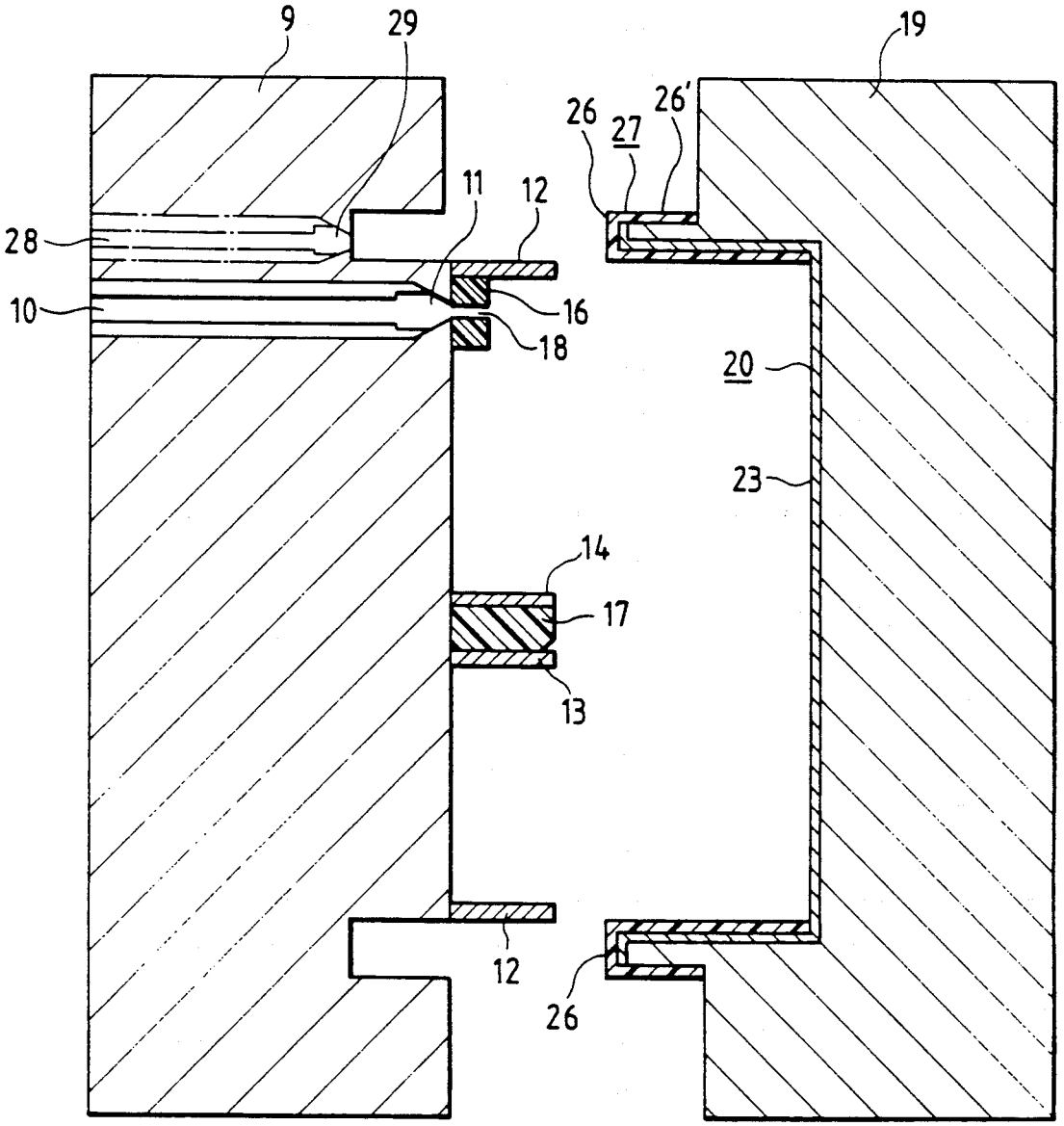
FIG. 5 is a cross-sectional view of the prior art injection molding before the mold is closed.
Figure 6:
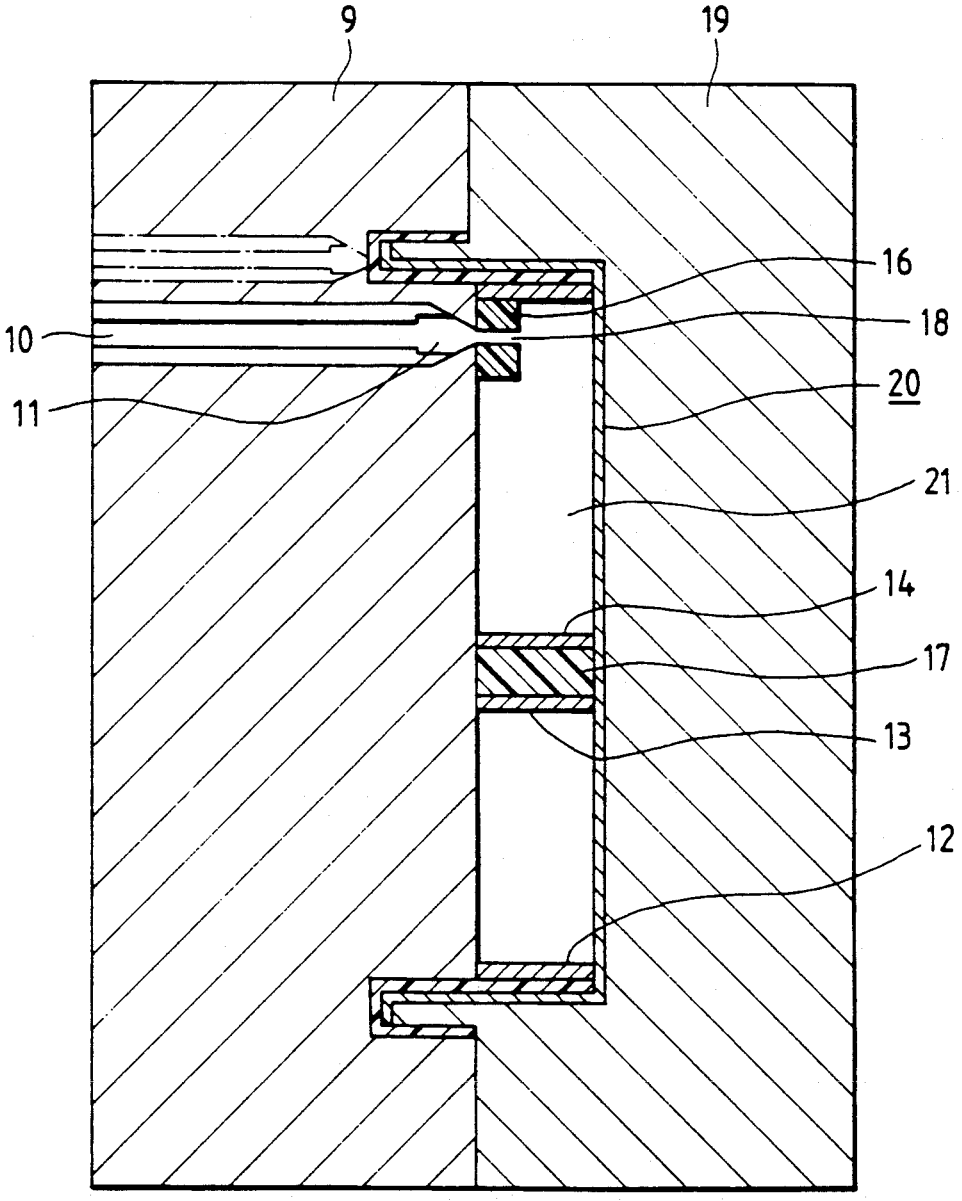
FIG. 6 is a view similar to FIG. 5 but showing the mold in its closed condition.
Figure 7:
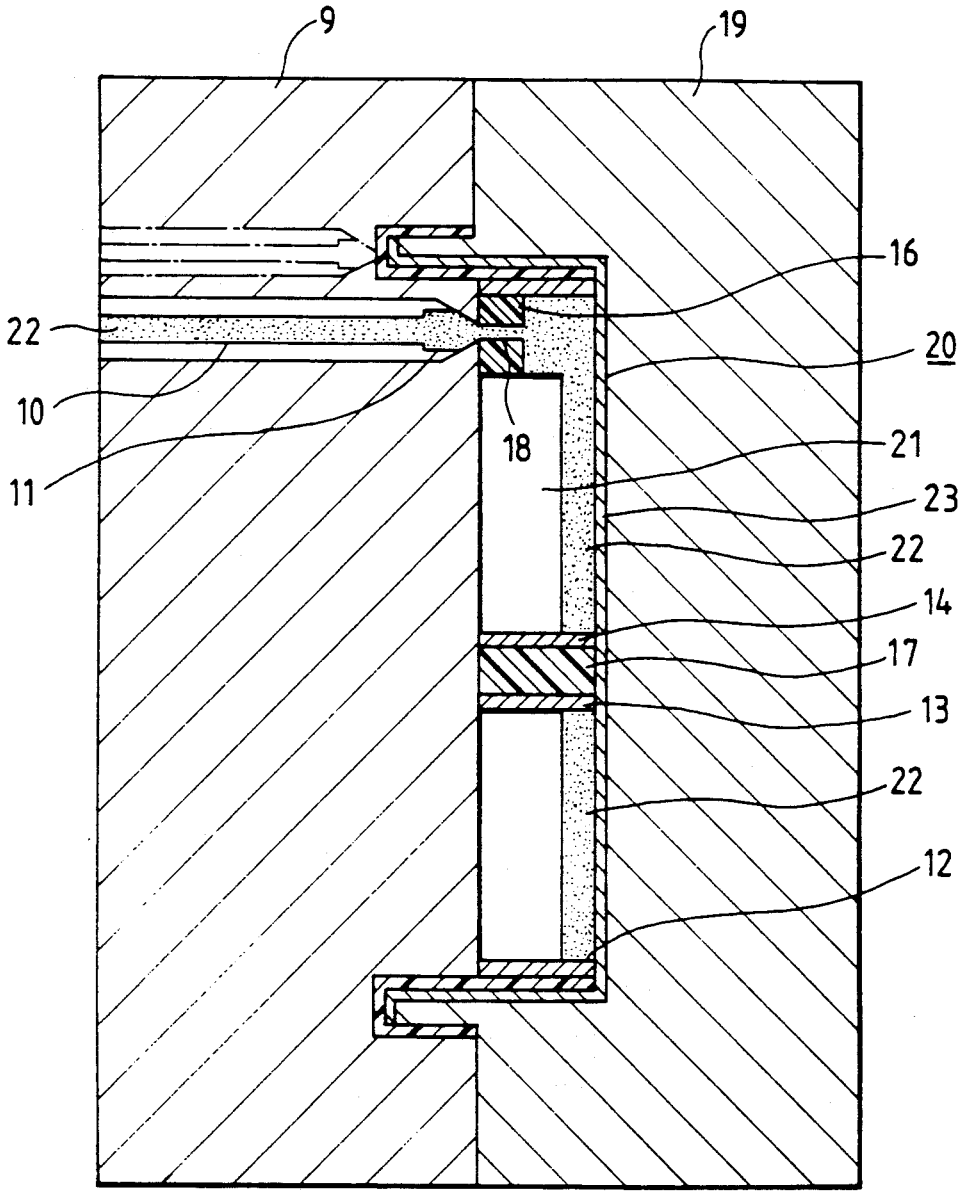
FIG. 7 is a view similar to FIG. 6 but showing the injection of a molding material.
Figure 8:
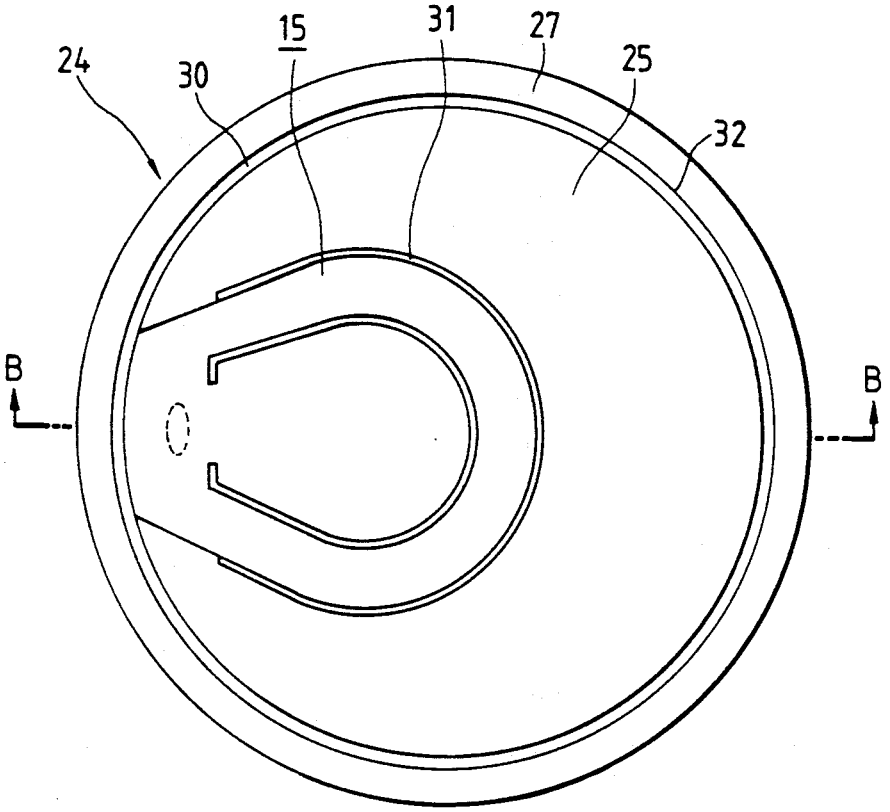
FIG. 8 is a top plan view of the lid.
Figure 9:
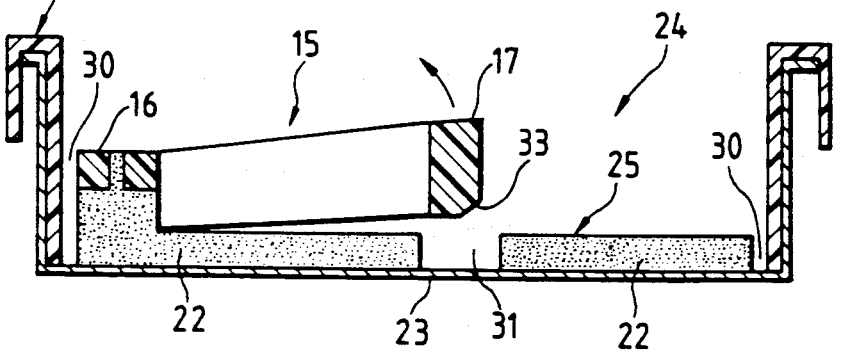
FIG. 9 is an enlarged cross-sectional view taken along the line B—B of FIG. 8.

The tab 15 of FIG. 2B may be replaced by one of a loop-shape shown in FIG. 4B or any other suitable type.

The tab 15 may be first secured to the tab seat 2 in the manner mentioned above, and then the tab seat 2 with the tab 15 may be mounted on the preformed base 23.

Next, modified forms of the invention will now be described with reference to FIGS. 1B to 1E.

Figure 1B:
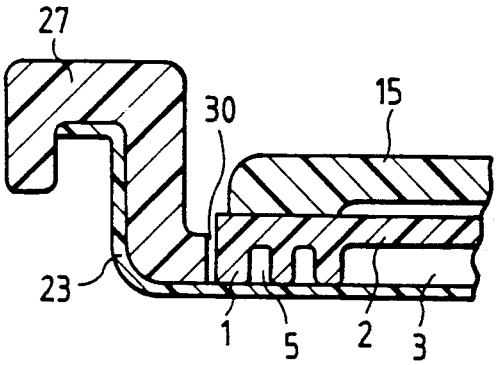
FIGS. 1B to 1E and 1C' are fragmentary cross-sectional views of the other preferred embodiments of lids of the present invention, respectively.

FIG. 1B shows another preferred embodiment of the invention in which the eave portion 4 of the tab seat 2 is omitted. In this embodiment, the score area can be reduced to a minimum by making the width of the score portion 30 as close to zero as possible.

Figure 1C:
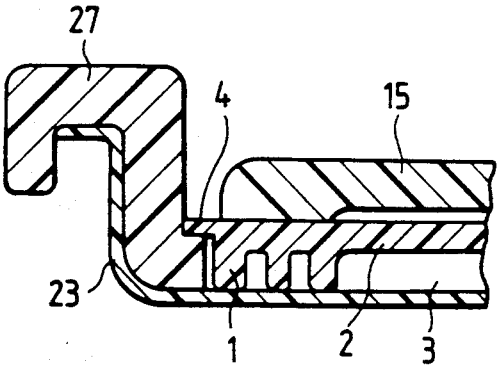
Figure 1C:
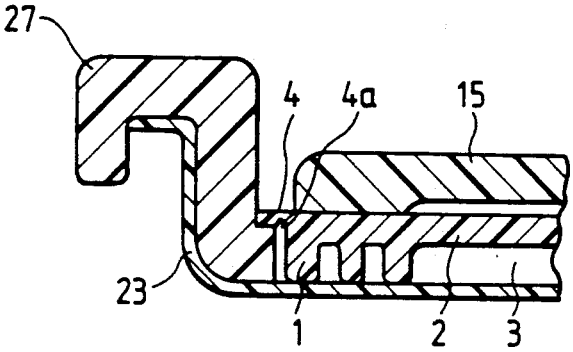

FIG. 1C shows a further preferred embodiment of the invention in which the eave portion 4 of the tab seat 2 overlaps and rests on the flap portion 27. If there is a risk that after the eave portion 4 is turned up, the score portion 30 is bored so as to introduce a foreign matter through such a bore in the case where the eave portion 4 is relatively thin, it is preferred that the eave portion 4 be bonded to the flap portion 27 with adhesives, or otherwise be brought into intimate contact with the flap portion without any adhesive. In the latter case, it is possible to form a hinge 4*a* for ensuring a hinge effect as shown in FIG. 1C.

Figure 1D:
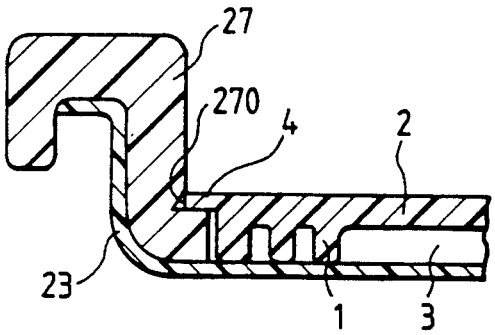

FIG. 1D shows a still further preferred embodiment of the invention in which a notch 270 having an inclined surface is formed in the inner peripheral surface of the flap portion 27, and the edge of the eave portion 4 is elastically bent or deformed to be fitted in the notch 270.

Figure 1E:
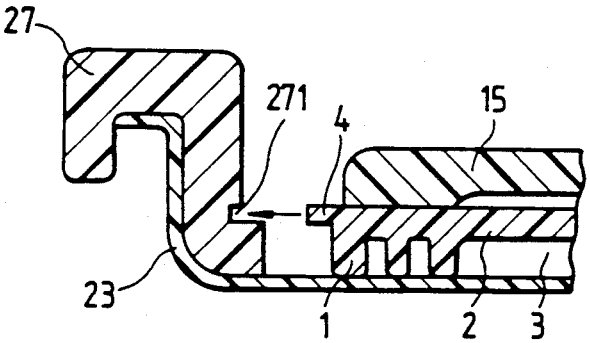

FIG. 1E shows a still further preferred embodiment of the invention in which a notch 271 of a channel-shaped cross-section is formed in the inner peripheral surface of the flap portion 27, and the edge of the eave portion 4 is fitted in the notch 271.

The score portion 30 can be covered more completely by the provision of the notch 270, 271 in which the eave portion 4 is fitted and further by fusing the eave portion 4 to the notch portion. This more positively eliminates the risk that a foreign matter is introduced into the can after turning up the eave portion 4 and boring the score portion 30.

The construction of the invention will now be described supplementarily.

Figure 10:
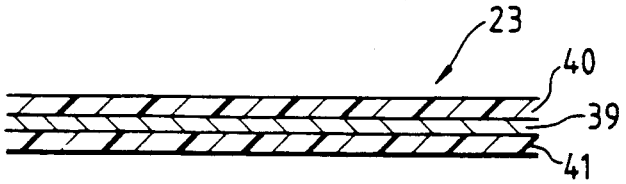
FIG. 10 is a fragmentary cross-sectional view of a barrier-type base.
Figure 11:
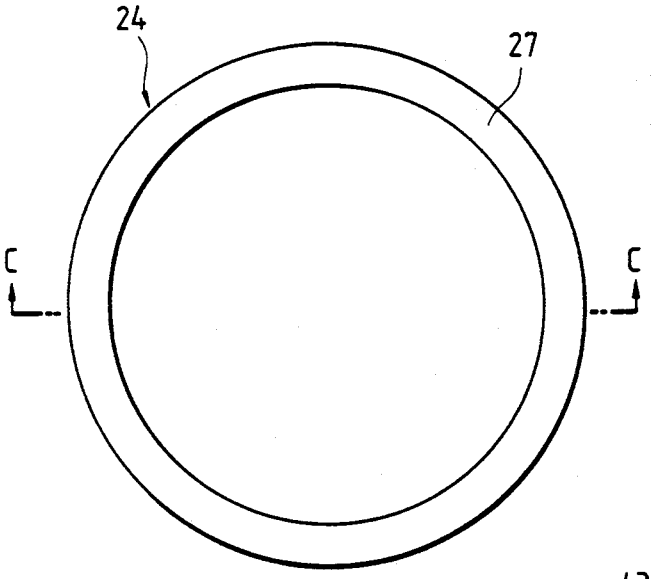
FIG. 11 is a top plan view of the lid after it is opened.

As described above, one example of the gas barrier-type multi-layer base 23 is cross-sectionally shown in FIG. 10. The multi-layer base 23 comprises the intermediate base layer 39 of the gas barrier type and the resin layers 40 and 41 formed respectively on the opposite sides of the base layer 39, the resin layers 40 and 41 being heat-fusible (heat-bondable).

It is necessary that the gas barrier-type base layer 39 should have so-called gas barrier properties so that the base layer 39 will not allow oxygen and impurities to pass therethrough.

For example, the gas barrier-type base layer or element 39 used in the present invention is made of a metal foil, the following sheet or the following film.

One example of such metal foil is an aluminum foil. Particularly, the present invention is embodied in the lid for a can-like container in which an aluminum foil is used as the gas barrier-type base element 39. Other examples of the gas barrier-type base element 39 include a sheet or a film of a saponifide of ethylene-vinyl acetate copolymer, vinylidene polychloride, polyamide, polyacrylonitrile or the like.

As described above, the lid 24 for a can-like container according to the present invention is so designed that the lid 24 can be opened by cutting the gas barrier-type multi-layer base 23 having the gas barrier-type base layer 39. Taking into consideration the degree of easy opening of the lid, the drop strength of the product (can), the rupture strength of the can and the breaking strength in connection with the shaping operation, it is preferred that the thickness of the gas barrier-type base layer 39 (made, for example, of an aluminum foil) should be not more than 50 μm, and more preferably 9 to 30 μm.

With such thickness, a complete incineration is possible, and the energy required for such incineration can be reduced to 11,000 Kcal/Kg or less, thus dealing with the problem of disposal of used cans.

Figure 13:
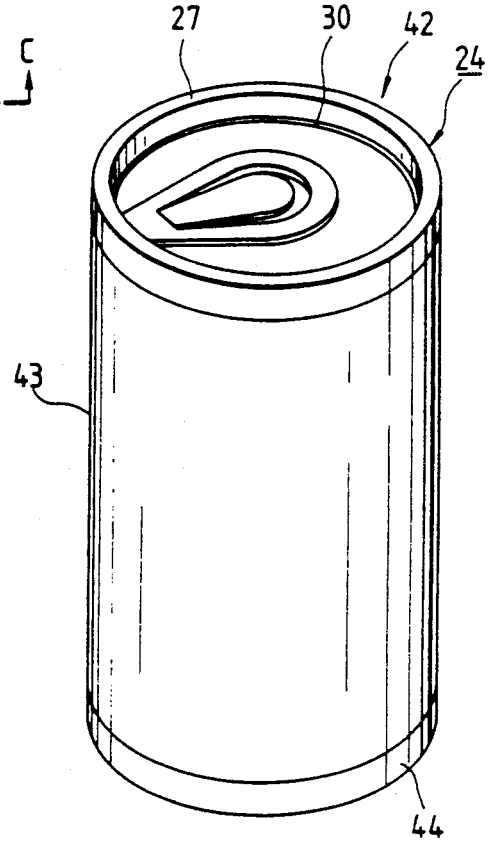
FIG. 13 is a perspective view of the can-like container.
Figure 12:
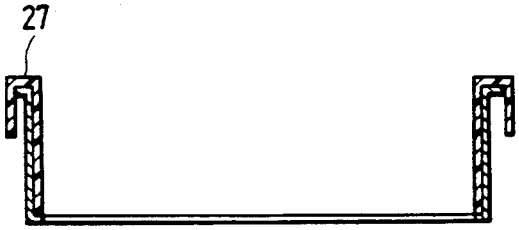
FIG. 12 is a cross-sectional view taken along the line C—C of FIG. 11.

For example, as shown in FIG. 13, the lid for a can-like container according to the present invention is secured to the container body by heat-bonding the flap portion 27 to the peripheral wall 43 of the can-like container 42. The surface of the peripheral wall 43 is also defined by a similar resin layer.

The heat-fusible outer resin layer 41 of the multi-layer base 23 of the lid 24 is bonded to the peripheral wall 43 of the can-like container whereas the heat-fusible inner resin layer 40 is heat-fused to the flap portion 27 and the tab seat 2. Thus, the lid can be firmly heat-bonded to the peripheral wall 43 through the outer layer 41, and the flap portion 27 and the tab seat 2 can be firmly heat-bonded to the inner layer 40 by ultrasonic welding or the like.

Examples of the resin of which the resin layers 40 and 41 are made include heat-fusible resins such as polyethylene, polypropylene and an ethylene-propylene copolymer.

The inner and outer layers 40 and 41 can be made of the same resin or different resins.

When the resin layers 40 and 41 are to be formed on the gas barrier-type base element 39, this can be done with or without an adhesive or an adhesive resin layer such as a film of a hot melt adhesive.

Preferably, the thickness of each of the resin layers 40 and 41 should be not more than 100 μm for the same reason as described above for the gas barrier-type base layer 39.

The flap portion 27 can be made of a thermoplastic resin similar to that of the resin layers 40 and 41.

If the resin layer 40 is made of an ethylene-propylene copolymer, it is preferred that the flap portion 27 be made of polypropylene.

If the resin layer 40 is made of polypropylene, it is preferred that the flap portion 27 be made of polyethylene.

The tab seat 2 as well as the tab 15 can be made of a synthetic resin similar to that of the flap portion 27.

Various additives such as an inorganic filler can be added to the synthetic resin of which the flap portion 27, the tab seat 2 and the tab 15 are made.

Although the invention made by the present inventor has been specifically described with reference to its preferred embodiments, the invention itself is not to be restricted to the above embodiments, and it will be appreciated that various modifications can be made without departing from the spirits of the present invention.

For example, after the tab seat with or without the tab 15 is attached in place, the flap portion 27 may be formed on the preformed base 23.

Further, although the above embodiments are directed to the lids for a circular can, the present invention is applicable to lids for cans of square, oval and other shapes.

According to the present invention, the drawbacks of the earlier invention are overcome, and the width of the score portion can be made close to zero. Further, the score portion is not exposed to the exterior to thereby eliminate the risk of the introduction of a foreign matter into the can, and an increased rupture strength of the can can be achieved.

I claim:

1. A method off manufacturing a lid for a can-like container comprising the steps of:

preforming a gas barrier-type multi-layer base of a flat shape for the lid into a predetermined shape having a substantially flat portion;

forming a reinforcing thermoplastic resin layer on said multi-layer base in such a manner that said reinforcing thermoplastic resin layer extends from the outer peripheral edge portion of said substantially flat portion of said multi-layer base;

mounting a tab seat of a synthetic resin on a portion of an upper surface of said flat portion of said multi-layer base surrounded by said reinforcing thermoplastic resin layer, said tab seat being disposed in spaced relation to said upper surface of said flat portion to form an enclosed space covering substantially the entire of said upper surface beneath said tab seat and disposed in such a manner that a score portion having as small a width as possible is formed between the outer periphery of said tab seat and the inner peripheral edge of said reinforcing thermoplastic resin layer, wherein said outer periphery of said tab seat is disposed on said upper surface of said flat portion to form a non-contact central portion of said lid, and said upper surface of said flat portion being exposed through said score portion, whereby said space absorbs energy when said container is dropped so as to emit energy; and securing one end of a tab of a synthetic resin to said tab seat.

2. A lid manufacturing method according to claim 1, further comprising a step of providing said base with an upstanding portion extending from the outer periphery of said flat portion, said multi-layer base comprising at least three layers and comprising an inner base layer of a gas barrier type and opposite outer surface layers of a thermoplastic resin.

3. A lid manufacturing method according to claim 1, in which said reinforcing thermoplastic layer extends around the outer end of said flange and further projects therefrom downwardly in substantially parallel relation to said upstanding portion so as to reinforce said upstanding portion and said flange.

4. A lid manufacturing method according to claim 1, further comprising a step of providing said tab seat with a rib formed at a lower surface of said tab seat.

5. A lid manufacturing method according to claim 1, wherein said securing step is performed prior to said mounting step.

6. A lid manufacturing method according to claim 1, wherein said securing step is performed after said mounting step.

7. A lid manufacturing method according to claim 4, wherein said mounting step includes positioning said ribs against said flat portion of said multi-layer base.

8. A lid manufacturing method according to claim 1, further comprising a step of forming said tab seat with an eave portion.

9. A lid manufacturing method according to claim 1, wherein said mounting step is performed by high-frequency welding.

10. A lid manufacturing method according to claim 1, wherein said mounting step is performed by ultrasonic welding.

11. A lid manufacturing method according to claim 1, wherein said mounting step is performed by means of an adhesive.

12. A lid manufacturing method according to claim 1, further comprising a step of notching said reinforcing thermoplastic resin layer.

* * * * *